US006845981B1

(12) United States Patent
Ko

(10) Patent No.: US 6,845,981 B1
(45) Date of Patent: Jan. 25, 2005

(54) CASINO GAME METHOD PROVIDING A SIDE WAGER BASED UPON A DEALER'S HAND

(76) Inventor: Shenli Ko, 9873 Ashton Pines Ct., Las Vegas, NV (US) 98147

( * ) Notice: Subject to any disclaimer, the term of this patent is extended or adjusted under 35 U.S.C. 154(b) by 0 days.

(21) Appl. No.: 10/342,883

(22) Filed: Jan. 14, 2003

Related U.S. Application Data

(60) Provisional application No. 60/422,559, filed on Oct. 30, 2002.

(51) Int. Cl.[7] ..... A63F 1/00

(52) U.S. Cl. ..... 273/292; 273/274; 273/309; 463/20

(58) Field of Search ..... 273/292, 274, 273/309; 463/12

(56) References Cited

U.S. PATENT DOCUMENTS 5,174,579 A * 12/1992 Griffiths ..... 273/292
5,248,142 A * 9/1993 Breeding ..... 273/138.1
5,257,810 A * 11/1993 Schorr et al. ..... 273/292
5,275,416 A * 1/1994 Schorr et al. ..... 273/292
5,280,915 A * 1/1994 Groussman ..... 273/292
5,390,934 A * 2/1995 Grassa ..... 273/292
5,395,119 A * 3/1995 Jacob et al. ..... 273/274
5,454,570 A * 10/1995 Karal ..... 273/292
5,494,296 A * 2/1996 Grassa ..... 273/292
5,673,917 A * 10/1997 Vancura ..... 273/292
RE35,968 E * 11/1998 Prerost ..... 273/292
5,836,586 A * 11/1998 Marks et al. ..... 273/292
6,170,828 B1 * 1/2001 Mostashari ..... 273/292
6,179,291 B1 * 1/2001 Vancura ..... 273/292
6,279,910 B1 * 8/2001 de Keller ..... 273/292
6,283,474 B1 * 9/2001 de Keller ..... 273/274
6,312,334 B1 * 11/2001 Yoseloff ..... 463/25
6,345,824 B1 * 2/2002 Selitzky ..... 273/292
6,394,456 B1 * 5/2002 Long ..... 273/292
6,503,145 B1 * 1/2003 Webb ..... 463/16
6,517,073 B1 * 2/2003 Vancura ..... 272/274
6,523,830 B1 * 2/2003 Yuan ..... 273/292
6,575,828 B1 * 6/2003 NewDelman ..... 463/16
6,607,195 B2 * 8/2003 Vancura ..... 273/274

* cited by examiner

*Primary Examiner*—Gregory Vidovich
*Assistant Examiner*—Dolores R. Collins
(74) *Attorney, Agent, or Firm*—Robert Ryan Morishita; Anderson & Morishita, LLC

(57) ABSTRACT

A method for playing an improved game of cards which includes a target value, such as Blackjack, is set forth. Prior to the dealing of a hand of play, a player makes a side wager, which proposition, is won or lost, based upon the (1) the dealer's hand exceeding the target value and (2) various parameters involving the dealer's hand or the dealer's and player's hand. One parameter is based upon the total number of cards in the dealer's hand. Another is based upon the sum value of the dealer's first two cards alone or in conjunction with the player's hand.

26 Claims, No Drawings

CASINO GAME METHOD PROVIDING A SIDE WAGER BASED UPON A DEALER'S HAND

CROSS-REFERENCE TO RELATED APPLICATION

This application is a continuation-in-part application to commonly owned application ser. No. 60/422,559 filed Oct. 30, 2002 and titled "Proposition Wager for Blackjack".

FIELD OF THE INVENTION

The present invention relates to Blackjack-style games and more particularly to methods for playing live and electronic machines for Blackjack-style games where there is a bonus feature.

BACKGROUND

There is known in the prior art casino card games where one or more players assemble hands of cards and compete against a hand representing a dealer's hand. One of the most common and popular such games is the game of Blackjack, sometimes referred to as "21." In a live Blackjack card game, each player makes a wager and the dealer deals two cards to each player to define an initial holding and two cards to himself defining a dealer's initial holding. The cards may be dealt from a single, standard deck of fifty-two playing cards, or from a "shoe" containing multiple decks of cards. The cards to the player(s) may be dealt face up or face down. For the dealer, in the traditional game, one of the dealer's cards in his initial holding is turned face up, which is often referred to as the "up" card, and the other card is dealt face down, which is often referred to as the "hole" card (in some European casinos the dealer will not-deal himself a hole card until all players have completed their hands). Each player, in turn, has the opportunity to complete their hand in a manner well known in the art. The object of the game is for the player to assemble a final hand which (1) has a higher count value than the dealer's final hand without the value exceeding a predetermined target value which, in traditional Blackjack, is 21. In this regard each player may exercise the following options:

1. To stand on the value of the initial holding making the initial holding the player's final holding;
2. Being dealt additional cards (taking "hits") to try to achieve or come close to the target value;
3. To "double down" (double their initial wager), which may be made, according to the casino's rules, sometimes only available when the count of the initial player hand is 10 or 11;
4. To split card pairs of the initial holding into two hands and play each hand separately;
5. To "surrender" their hand by giving up half their wager (this may not be permitted by some casino rules or only permitted when the dealer has a certain value of the exposed card); and/or.
6. Take insurance by wagering an amount equal to their game wager and if the dealer has a "Blackjack" or "natural" (initial holding composed of an Ace and a ten-value card), the player wins 2:1 and therefore, basically, does not win or lose.

As stated above the rules of traditional Blackjack regarding the player's actions are well known in the art.

Once the players have completed their hands, the dealer does as well by taking hits or standing according to the house rules. A variation included in those rules is that the dealer may be required to stand on a "soft 17"(i.e., a hand count of 17 including an Ace which counts as a 1 or an 11). Other rules require the dealer to hit a soft 17.

If the player exceeds the target value of "21" they, lose their wager regardless of whether the dealer also exceeds the target value. This is because the players complete their hands first. If the player's hand does not exceed the target value and (1) his hand has a value exceeding the dealer or (2) the dealer exceeds the target value, the player wins and is paid 1:1 on their game wager. If 1.5 the dealer does not exceed the target value and his hand has a greater value than the player's final hand, the player loses their wager. If the player's and the dealer's final hand values are the same, it is a tie (or "push") and the player neither wins nor loses.

In traditional Blackjack the hand values are based upon a card valuing schedule as follows:

| Card | Value |
|---|---|
| Ace | 1 or 11 |
| K, Q, J, 10 | 10 |
| 2–9 | card value |

It has also been known to program a computer for a player to play the game against the computer. Hand held, electronic, Blackjack game devices have also been known.

In what many consider to be a drawback with traditional Blackjack, the most the player can win is a 3:2 award based on their game wager which occurs when the player has a natural and the dealer does not have a natural. Recently some casinos have reduced the award to 6:5. Thus there is no offering for the player to win a greater amount.

Another Blackjack-style game is known as "Spanish 21" where all the "10s" are removed from the deck. The game plays like blackjack although the odds are slightly worse for the player due to the removal of the 10s.

Yet another Blackjack-style game is known as "No Bust 21" or "21$^{st}$ Century Blackjack" where no hands can "bust." If the player hand goes over 21, instead of losing their wager immediately as in traditional Blackjack, the player's is wager stays until the dealer plays out his hand. Unless the dealer hand also goes over 21 and is closer to 21 than is the player hand, the player won't lose the wager.

Some Blackjack-style games have been adopted and played which provide for a side ("bonus") wager that (1) the dealer will have a Blackjack, (2) the dealer's hand will have a certain combination of cards such as suited Queens, or (3) the dealer will take a certain number of hits, or (4) the dealer will bust.

In Griffiths, U.S. Pat. No. 5,174,579, there is disclosed a Blackjack side wager "21 or over". The player making this side wager is betting that the dealer will either bust or achieve exactly a hand count of 21 with 3 or more cards. When the dealer has either busted or achieved an exact hand count of 21, the player is paid according to predetermined odds of 1:1, 3:2 or 2:1. One drawback to this wager is the low payoff odds which limit the attractiveness of the game. There are many Blackjack side wagers that pay much higher odds such as a game known as Lucky Ladies where the top payoff odds are 1000:1 if the player has a hand of Queens of the same suit. Thus "21 or over" won't be enticing, exciting enough for the players. The reason "21 or over" cannot pay odds more than 2:1 is that its hit frequency (probability of the occurrence during play) of 36% is too high. In a "Blackjack game dealt from 6 decks with the "dealer hits a soft 17" rule, a dealer will bust 28.58% of his hands and achieve a count of 21 7.49% of the time. Since the odds are only 1.78:1 against winning a bet with a hit frequency of 36%, there is no way the casino can pay odds higher than 1.78:1, and even with a dealer hand count of 21 being a push, 2.24:1 would be the highest odds the casino can pay without incurring a loss.

In Keller, U.S. Pat. No. 5,816,575, there are disclosed a number of side wagers, one of which allows the player to bet that the dealer will go bust. When the dealer busts, the player is paid at 5:2 (i.e., 2.5:1) odds. Again, like 21 or over", the payoff odds for the side wager are unattractive. Furthermore, since the odds against the dealer going bust are only 2.499:1, the casino won't have an advantage if the side wager is paid 2.5:1. Thus the casino would not have a profit motive for hosting a game with such a side wager.

In Forte, U.S. Pat. No. 5,934,998, there is disclosed a side wager that rewards the player if the number of consecutive dealer bust hands has exceeded a predetermined dealer bust event threshold of 5. The drawback to such a wager is that it not only requires additional equipment such as electronic displays and counters to tally the dealer bust event for every player, but once the dealer starts to bust, the player has to stay and continue to play until the dealer either stops busting or reaches the predetermined threshold. Hence side wagers that cannot be resolved in one single hand or round of play require more supervision and cause inconveniences for the players. Further, because new players may enter the game during the dealer busting sequence, maintaining the tally for each player is difficult and likely to lead to disputes.

In Vancura, U.S. Pat. No. 5,673,917, there is disclosed a side wager for the player to make in addition to their base game wager in Blackjack. According to this patent, in one embodiment, the player may make a side wager based upon the number of "hits" the player will take in completing their hand. They are paid for their side wager according to one of several suggested pay tables. One drawback to this game embodiment is that the side wager is either fixed, a percentage of the base wager, or confined within strict limits to counteract the effect of an advantage obtained by professional card counters. When the outcome of a side wager depends on the base wager or is confined within limits determined by the possible effects of card counting (optimal advantage play by a card counter to beat the game) in a game where skill can impact the frequency and amount won such as Blackjack, most players will, in regard to the side wager, lose more than they should. The strategy for this side wager will presumably comprise a set of 2- to N-card strategies, where N equals the maximum winning number of successful hits minus 1 and each multi-card strategy is a matrix composed of "hit or stand" rules based on the player's current hand total of 12 through 20 versus the ten dealer up cards for a total of 90 rules times (N×2)! Furthermore, since the base wager and the side wager are paid at different odds, the optimal strategy will vary with the ratio of the base wager to to the side wager, thereby necessitating memorizing many more strategy deviations if the player wants to vary their wager size, which they often do. Thus the size of the side wager had better be a fixed amount or fraction of the base wager as stated in his claims 20 to 23.

Another embodiment described in Vancura is that the player may make one or more side wagers where he/she is attempting to predict the exact number of hits the dealer or player will take. If the player incorrectly predicts the exact number, e.g., the player wagers on two hits and the dealer only takes no hits, one hit or three or more hits, the player loses their side wager. There are several drawbacks to this side wager. First, the player must accurately and precisely predict the number of the dealer hits. If he does not so predict, the player loses their side wager. Second, the outcome of the side wager is also dependent upon the player hand. For the side wager where the player is predicting the number of dealer hits, exact prediction is required for the player to win their side wager. For the side wager on the number of player hits there is disclosed an "over" wager, i.e. three or more hits. Second, the outcome of the side wager is also dependent upon the player hand. Also, according to certain disclosed embodiments, if the player receives a natural (Blackjack), the side wager is a push. This means the player won't have a chance to win the bet an additional 4.7% of the time (the statistical frequency of player Blackjack(s)). Also, the side wager either pushes or loses if the player exercises one of such options as surrender, double down and splitting. This further deprives the player of their chances to win the side wager an additional 12% of the time. The requirement to precisely predict the dealer's hits and the dependency of the outcome of the side wager on the player hand reduce the frequency that the player will win their side wager. If players do win or see other side wagers won relatively frequently, they may abandon the game or at least the side wager. Further, since precise prediction is required for side wagers based on the dealer's hand, players may become frustrated by infrequent wins of the side wager. As for wagers on the player's hand, often the player will be put into a situation where they must choose between winning their base wager and trying to win their side wager. This creates a stressful situation which may cause casual players to shun the side wager altogether. It is further noted that limiting the side the side wager to ⅕ of the base game wager not only reduces both the excitement and betting action for the player and the revenue for the casino, but it also creates difficulties in calculating the exact bet amount for the player and in calculating and making the payment for the dealer as well when the bet amount is not a multiple of 5. Imagine a player making a base wager of $17.

Hence there is a need for a game which:

1. does not require an accurate, precise, prediction of the number of hits taken by the dealer to complete their hand;
2. does not restrict the size of the side wager;
3. does not depend upon the play of the player hand for adjudicating the side wager;
4. is not tied to the base wager;
5. pays handsome awards when the player wins;
6. can provide a trigger event which increases the players side wager award; and
7. is configured to provide an acceptable advantage for the casino.

SUMMARY OF THE INVENTION

There is, therefore, set forth according to the present invention a method of play of a Blackjack-style game which provides for a side wager and which overcomes the drawbacks noted above.

The improved method for playing a Blackjack-style card game includes using representations of a deck of cards (playing cards or, for an electronic device, generated representations), where the rules of the game have a predetermined target value which, if exceeded by the dealer's hand value can be declared a dealer hand bust. For traditional Blackjack or Spanish 21, this target value is 21. For "No Bust 21," this target value is also 21, despite that a dealer hand that goes over 21 is not said to "bust." The improved game includes the dealers hand receiving, according to the rules of the game, an initial set of cards S. For most, if not all Blackjack-style games, this set S is one or two cards, depending on whether the house rules require the dealer not to take a "hole" card before all players have completed their hands. However, whether the dealer takes a hole card before the players complete their hands does not change the probability of the dealer going over the predetermined target value. The method includes the player making a game wager according to the rules thereof and a side wager. Cards are distributed, e.g., dealt or displayed to the player and to the dealer, according to the rules of the game. For an improved, Blackjack-style game, initially each player is dealt a hand of two cards and the dealer is dealt one or two cards according to the house rules. The dealer and player complete their hands according to the rules of the game including the dealer's hand receiving a set of cards C in addition to said initial set S. The method includes resolving the game wager according to the rules of the game, e.g., according to the rules of Blackjack.

The improvement further includes resolving the side wager according to the rules of, (1) if the dealers hand does not exceed a predetermined target value, the player losing their side wager;

(2) if the dealer's hand exceeds a predetermined target value and the sum of cards in C+S exceeds a predetermined number of cards, issuing a bonus award to the player, otherwise the player losing their side wager, (3) if the dealer's hand exceeds a predetermined target value, issuing a bonus award to the player according to the point total of the card(s) in S and a predetermined multiplier in C+S, or (4) if the dealer's hand exceeds a predetermined target-value, issuing a bonus award to the player according to the point total of the card(s) in S and the sum of cards in C+S.

Thus, for example, if the value sum of cards in the dealer's hand that goes over the predetermined target value (e.g. "21" for a Blackjack game) is 4, the player may win a first award. If the number is 5, the player may win a different, greater award and so forth. The award may also be based upon sum groups as well. For example, if the sum of cards is 3 to 5, the player may win a first award and if the sum is 6 to 7 the player may win a different award.

In a further embodiment, in determining the sum and bonus award, certain preselected cards may be subtracted from the sum. For example, if one of a 10, Jack, Queen or King is in the dealer's hand, that card is not considered in determining said sum for the purpose of determining the award. Alternatively, such preselected cards are only subtracted (not counted) if they appear as the dealer's up card in set S, or in set C, or in either of sets S and C.

In still a further embodiment, one or more cards may be designated as trigger cards used as an odds multiplier. Should a trigger appear in the dealer's hand, any bonus award to the player(s) is increased. For example, if a 2 is in the dealer's hand and the dealers hand goes over the predetermined target value and if the sum of cards meets the criteria for issuing an award, the award may be increased such as by being doubled.

In still a further embodiment, the point or value total of each initial two-card holding in set S determines the payoff odds when the dealer hand goes over the predetermined target value and the sum of cards in C+S shall determine whether the payoff odds should increase. There are fifteen (2 through 16) point totals possible in set S. In case the dealer does not take a hole card until all players complete their hands, the first card the dealer draws is considered to be in S.

The features of not requiring the player to precisely predict the number of hits taken by the dealer, provides a greater frequency that the players are issued a bonus award. The feature of scaling up the payoff odds based on the frequency of occurrence of the various dealer hands going over the predetermined target value (i.e., the sum of cards and the fifteen initial dealer two-card totals) enables the game to reward the players both proportionally and handsomely. The variant feature of discounting certain cards from the sum of the dealer's hand that goes over the predetermined target value, can act to, if desired, configure the award frequency and pays to make the game acceptable to the players and the casino. It also helps eliminate its vulnerability to card counting if those cards which are found to be in favor of the card counter when a surplus of such cards exists in the remaining portion of the deck to be dealt are discounted. The feature of the multiplier for increasing the amount of the bonus awards to the player(s) also increases the suspense and excitement attendant to the bonus feature. Furthermore, since the bonus award is based upon the dealer's hand, all player(s) are wagering on the same event and therefore win together. This promotes a comradery among the players. Last but not least, no matter how they choose to play their hand against the dealer, the players play of their hand will not affect the outcome of the player's side wager.

DESCRIPTION

The method of the present invention hereinafter set forth provides for a side, or bonus wager, for a Blackjack-style game. By Blackjack-style game what is meant is a game where there is a target value set for the valuation of the hands, players receive hands of cards as does a dealer, and winning and losing of the Blackjack-style game is based upon comparison of the dealer's and player's hands inter se as well as in relation to the target value. In connection with Blackjack-style games, the method of play of tradition Blackjack is well known but will briefly be described to aid in the understanding of the present invention. Other such Blackjack-style games include games such as "Spanish 21" as described in Lofink et al, U.S. Pat. No. 5,615,888 and "No Bust 21" as described in Mostashari, U.S. Pat. No. 6,170,828, the disclosure of which is hereby incorporated by reference as well as Blackjack games which offer various side wagers.

TRADITIONAL BLACKJACK GAME METHOD

The game, as is well known, is played by the player making a game wager to participate in the game. Once the players have made their wagers, the dealer deals to each participating player an initial hand of two-cards and deals himself an up card and a hole card to define an initial dealer's set S of cards. Each player, in turn, Is provided with several options to complete their hands. The basic object of the players' actions is to complete their hands to have a card sum value equaling or getting close to the game's predetermined target value, which for traditional Blackjack, is "21." If the player's hand exceeds the target value, they automatically "bust" and lose their game wager. In summing the cards, the following values are assigned to the cards:

| Card | Value |
|---|---|
| Ace | 1 or 11 |
| K, Q, J, 10 | 10 |
| 2–9 | card value |

As is well known in the game of traditional Blackjack, the following options may be exercised by each player:

1. The player may stand on the sum value of the initial two cards. For example, if the player has a Queen and an 8, their card sum value is 18 and the player would stand. If the player has a 4 and a 6, their initial holding (set S) has a value sum of 10 and the player would take at least one or more additional card(s), or "hit(s)."

2. The player may take one or more hits. For example, if the player's initial hand is a 4 and a 6, the player would take an additional card. If the first hit card is, for example, a 2 for a hand sum value of 12, the player may take another hit. If the second hit card is a Queen, the sum value would be 22 and the player would bust and immediately lose the game wager and be out of the hand of play. If the second hit card is a 9, the player would stand on a hand sum value of 21.

3. The player may, according to some rules, surrender their hand and one-half of their wager.

4. The player may "split" if their first two cards are a pair, e.g., a pair of 8s. The player matches their initial wager and splits each of the 8s into separate hands and hits or stands according to the above.

5. The player may double down on their first two cards. For example, if the player has a 4 and a 6 the player may double their game wager and receive one additional card to complete their hand.

6. If the dealer's up card is an Ace, the player may take insurance by matching their game wager. If the dealer has a ten-value hole card for a natural, the player loses their game wager but is paid 2:1 on their insurance wager thus resulting in no loss to the player.

It should be noted that where the dealer's up card is an Ace and the dealer has a natural, the player automatically loses their wager and, except for insurance, can exercise no other option.

Certain rules may be adopted such as, if the dealer's up card is an Ace and the player has a natural, the player may elect to receive a 1:1 payment on their game wager before the dealer checks the hold hole card for a natural.

After all players have exercised their options in regards to their hand the dealer completes his hand. The dealer's actions are generally according to the following rules.

If the dealer's hand sum value is less than 17, the dealer would take additional cards defining a set C of additional cards until his hand sum value is equal to or exceeds 17. Some rules require the dealer to stand on a soft 17 and some rules require the dealer to hit a soft 17. If the dealer's hand sum value exceeds the target value of 21, the dealer busts and he loses and all players who have not previously busted themselves, win their game wagers and are paid 1:1. If the dealer does not bust, the game wagers are resolved by comparing the dealer's hand sum value to that of each player in succession. If the player's value exceeds the dealer's, the player wins and is paid 1:1 based on their game wager. If the dealer's value is greater than the player's, the player loses their game wager. If the hand values tie, it is a push and the player neither wins nor loses.

If the player has a natural (a Blackjack of an Ace and a 10-value card in set S), and the dealer does not, the player is awarded a pay greater than 1:1 such as 3:2 or 6:5.

After resolution of the hands, the players make new wagers and a new hand is played.

A drawback of the traditional, base game, of Blackjack is that the highest award (except for the insurance wager) to the player is for a natural which is paid 3:2 or 6:5. All other wagers are paid at even money (1:1).

The Side Wager

According to the present invention, the players are permitted to make an optional side wager. The side wager, according to one embodiment, is won or lost based upon the following criteria:

1. If the dealer hand does not exceed a predetermined target value (e.g. 21), the player loses their side wager.

2. If the dealer hand exceeds a predetermined target value, the player wins an amount according to a pay table which relates the number of cards in the dealer's hand (sets S and C) to a bonus award. An example of such a table based on a predetermined target value of 21 is shown in Table 1.

TABLE 1

| Number of Cards | Award (times side wager) |
|---|---|
| 3 | 1 |
| 4 | 2 |
| 5 | 8 |
| 6 | 20 |
| 7 | 50 |
| 8 | 500 |
| 9 | 5000 |

Other pay tables may be adopted as well.

Thus, if the player made the side wager of $5 and the dealer's hand is 3, 2 (set S) and 7, 2, Ace and King (set C), there are six cards in the dealer's hand (S +C) and according to the example pay table above, the player would be paid $5×20=$100 on their side wager.

Thus the player does not have to accurately predict the number of "hits" the dealer will take to win. Thus the frequency at which the players will win their side wagers will increase. Further, since all players who have made the side wager will be paid if the award criteria are met, the comradery between the players increases.

In a further embodiment, certain cards may be designated to be subtracted from (not counted) the dealer's hand sum in determining whether the award criteria have been met as well as the award. For example, all ten-value cards may be designated as being subtracted from the sum. As but an example and using the pay table below, the following may occur:

1. The dealer hand is composed of 2, 4, King and 8 for a total value of 24, thus exceeding the predetermined target value of 21.

2. The dealers card sum would be 4−1 (the ten-value card of the King is subtracted) for a total of 3. The player would be paid the odds for cards on their side wager.

An example of such a table based on a predetermined target value of 21 is given in Table 2.

TABLE 2

| Number of Cards | Award (times side wager) |
|---|---|
| 1 or 2 | 1 |
| 3 | 2 |
| 4 | 3 |
| 5 | 5 |
| 6 | 10 |
| 7 | 25 |
| 8 | 100 |
| 9 or more | 1000 |

This variant of the game of the present invention may also be varied to only subtract those predetermined cards only when they appear in the initial set S of dealer's cards or just in the dealer's up card in set S.

Still another variant is to subtract the predetermined card when it appears in the additional card set C of the dealer's hand.

As an additional feature to the game, certain cards may be designated as triggers to enhance the award of the side wager to the player. As but an example, if the dealer hand that exceeds the predetermined target value meets the criteria for an award to the players and contains one or more predetermined trigger cards or card combinations, the award may be increased as by multiplying the award. For example, "7s" may be designated as such triggers and be a multiplier of 2. As long as there is a 7 in a dealer hand that goes over 21, the 2. An example of a pay table based on a predetermined target value of 21 is shown in Table 3.

TABLE 3

| Number of Cards | Award (times side wager) |
|---|---|
| 3 | 1 |
| 4 | 2 |
| 5 | 5 |
| 6 | 10 |
| 7 | 25 |
| 8 | 100 |
| 9 | 1000 |

The following would be an example of the application of the triggers using Table 3;

The dealer hand is composed of 7, 7, Ace, Ace and 10, for a total of 0.5 cards. Since it pays 5 to 1 for 5 cards and there is a 7 in the dealer's hand, the player's award would be 5×2=10 times the wager. Further, all multipliers in the dealer's hand can be added up to become a larger multiplier. For example, three 7s in the dealer's hand will increase the multiplier to 2+2+2=6.

Still further, all multipliers in the dealer's hand can be multiplied to become a larger multiplier. For example, three 7s in the dealer's hand will increase the multiplier to 2×2×2=8.

Still further, each additional 7 in the dealer's hand may represent a different multiplier. Thus, the following would be examples of the application of the triggers:

(1) The dealer hand is composed of 4, 5, 6 and 7 and the player's award would be two times the base bonus award because there is one 7.

(2) The dealer hand is composed of 7, 7, 2 and 10 and the player's award would be triple the base bonus award because there are two 7s.

(3) The dealer hand is composed of 7, 7, A, A and 7 and the player's award would be five times the base bonus award because there are three 7s.

Other cards or card combinations in the dealer's hand may be used as triggers.

As above, the triggers may be constrained to appear in the dealer's initial hand set of cards S or in the additional card set C. However, it is preferred that the triggers may be in any component C, S or C+S to trigger the enhanced award.

As still a further embodiment, if the dealers hand exceeds a predetermined target value of 21, a bonus award will be issued to the player according to the value sum of the card(s) in S and the sum of cards in C+S. Aces count as 1 only for the purpose of determining the appropriate payoff odds for the side wager. An example of a pay table for multipliers for this embodiment is given in Table 4.

TABLE 4

| Initial Dealer 2-card | Sum of cards in the dealer's hand that exceeds 21 | |
|---|---|---|
| Total | 5 or less | 6 or more |
| 2 (A & A) | 30 | 60 |
| 3 | 15 | 30 |
| 4 | 8 | 12 |
| 5 to 9 | 3 | 10 |
| 10 | 3 | 50 |
| 11 | 3 | 50 |
| 12 | 1 | 100 |
| 13 | 1 | 1000 |
| 14 or more | 1 | impossible |

For example, if the dealer's hand is composed of 4, 8 (set S) and A, A, 2 and 9 (set C), in that order, for a final total of 25, the player will be paid 100 to 1 because the initial dealer two-card total is 12 and there are six cards in the dealer's hand.

As still a further embodiment, a predetermined card is used as a multiplier to increase the payoffs if at least one such card exists in the dealer's hand. For example, if the dealer's hand exceeds a predetermined target value of 21, a bonus award will be issued to the player according to the point total of the card(s) in S. Furthermore, if the dealer's hand contains the multiplier card, then the payoff is increased. Aces count as 1 only for the purpose of determining the appropriate payoff odds for the side wager. An example of a pay table for this embodiment wherein the multiplier is a 6 is given in Table 5.

TABLE 5

| Initial Dealer 2-card | Does the multiplier exist in the dealer's hand that exceeds 21? | |
|---|---|---|
| Total | No | Yes |
| 2 (A & A) | 20 | 500 |
| 3 | 10 | 50 |
| 4 | 6 | 30 |
| 5 | 3 | 20 |
| 6 to 11 | 3 | 5 |
| 12 to 13 | 1 | 3 |
| 14 or more | 1 | 1 |

For example, if the dealer's hand is composed of A, A (set S), 4, 6 and 10 (set C) in that order, for a final total of 22, the player will be paid 500 tol because the initial dealer two-card total is 2 and there is a 6 in the dealer's hand.

Further, as described earlier, certain cards can be discounted from the set of S, C or S+C and/or certain cards can be designated as triggers.

Further, certain 2-card totals can be discounted from the set of S to enhance the payoff odds at the low end of the pay table. An example of the 2-card total of 13 being excluded is given in Table 5.1:

TABLE 5.1

| Initial Dealer 2-card | Does the multiplier exist in the dealer's hand that exceeds 21? | |
|---|---|---|
| Total | No | Yes |
| 2 (A & A) | 20 | 500 |
| 3 | 10 | 50 |
| 4 | 6 | 30 |

TABLE 5.1-continued

| Initial Dealer 2-card Total | Does the multiplier exist in the dealer's hand that exceeds 21? No | Yes |
|---|---|---|
| 5 | 3 | 20 |
| 6 to 11 | 3 | 5 |
| 12 | 2 | 4 |
| 14 or more | 1 | 1 |

As still a further embodiment, the side wager bonus award may be enhanced by the character of a player's initial holding that needs no draw. For example, a natural or a two-card "pat" hand of hard 17 to 20 needs no further action by the player. Thus, it can be awarded according to the following criteria:

1. The dealer's hand exceeds a predetermined target value and the player is entitled to an award based upon the applicable dealer hand card sum;
2. The player's hand has at least one predetermined holding such as, if the player has a natural, the pay table award would be multiplied by 2× or 3×. The examples given below assume that a player natural acts as a multiplier of 2×.

An example of this application is given in Table 6.

TABLE 6

| Number of Cards | Award | Award When Player Has a Natural |
|---|---|---|
| 3 | 1 | 2 |
| 4 | 2 | 4 |
| 5 | 8 | 16 |
| 6 | 20 | 40 |
| 7 | 50 | 100 |
| 8 | 500 | 1000 |
| 9 | 5000 | 10000 |

Another example is given in Table 7.

TABLE 7

| Initial Dealer 2-card Total | No Player Natural | Player Natural |
|---|---|---|
| 2 | 40 | 80 |
| 3 | 20 | 40 |
| 4 | 8 | 16 |
| 5 to 9 | 3 | 6 |
| 10 | 3 | 6 |
| 11 | 3 | 6 |
| 12 | 1 | 2 |
| 13 | 1 | 2 |
| 14 or more | 1 | 2 |

Another example is given in Table 8.

TABLE 8

| | Sum of cards in the dealer's hand that exceeds the target value of 21 | | | |
|---|---|---|---|---|
| | 5 or less | | 6 or more | |
| Initial Dealer 2-card Total | No Player Natural | Player Natural | No Player Natural | Player Natural |
| 2 | 30 | 60 | 80 | 160 |
| 3 | 15 | 30 | 40 | 80 |

TABLE 8-continued

| | Sum of cards in the dealer's hand that exceeds the target value of 21 | | | |
|---|---|---|---|---|
| | 5 or less | | 6 or more | |
| Initial Dealer 2-card Total | No Player Natural | Player Natural | No Player Natural | Player Natural |
| 4 | 8 | 16 | 10 | 20 |
| 5 to 9 | 3 | 6 | 10 | 20 |
| 10 | 3 | 6 | 30 | 60 |
| 11 | 3 | 6 | 30 | 60 |
| 12 | 1 | 2 | 100 | 200 |
| 13 | 1 | 2 | 1000 | 2000 |
| 14 or more | 1 | 2 | impossible | impossible |

As stated above the enhancement of the award may be triggered by at least one predetermined card or card combination occurring in the dealer's hand or in the player's hand.

Any of the foregoing methods can be incorporated into electronic Blackjack-style games. For example, for video Blackjack, the device may be configured to permit the player to lodge their side wager and play the base game as well as the bonus award game of the present invention.

While I have described certain embodiments of the present invention, it should be understood that it is subject to modifications and changes which do not depart from the spirit and scope of the invention.

I claim:

1. An improved method for playing a Blackjack-style card game using representations of a deck of cards, where the rules of the game have a predetermined target value and where according to the rules of the game the dealer's hand receives an initial set of cards S, the improved method comprising:

each player making a main wager according to the rules thereof and an optional side wager;

distributing cards to the player and to the dealer according to the rules of the game;

the dealer and player completing their hands according to the rules of the game including the dealer's hand receiving a set of cards C in addition to said initial set S;

resolving the game wager according to the rules of the game;

resolving the side wager according to the rules of, (1) if the dealer's hand does not exceed the predetermined target value, the player losing their side wager; and (2) if the dealer's hand exceeds the predetermined target value and the sum of cards in S+C exceeds a predetermined number of cards issuing a bonus award to the player, otherwise the player losing their side wager.

2. The method of claim 1 comprising, if the number of cards in S+C exceeds a predetermined number issuing an award to the player based upon the side wager and the number of cards in S+C.

3. The method of claim 2 comprising, if the number of cards in S+C exceeds a predetermined number, issuing an award to the player based upon

TABLE 1

| Predetermined Number of Cards | Award (times side wager) |
|---|---|
| 3 | 1 |
| 4 | 2 |
| 5 | 8 |
| 6 | 20 |
| 7 | 50 |
| 8 | 500 |
| 9 | 5000. |

.

4. The method of claim 1 comprising excluding at least one predetermined card from the sun of cards in a predetermined one of (i) C, (ii) S or (iii) C+S in determining whether C+S exceeds said predetermined number of cards.

5. The method of claim 1 comprising excluding 10s through Kings.

6. The method of claim 5 comprising issuing and award to the player based upon

TABLE 2

| Predetermined Number of Cards | Award (times side wager) |
|---|---|
| 1 or 2 | 1 |
| 3 | 2 |
| 4 | 3 |
| 5 | 5 |
| 6 | 10 |
| 7 | 25 |
| 8 | 100 |
| 9 or more | 1000. |

.

7. The method of claim 1 comprising increasing the bonus if at least one of (i) a predetermined card or (ii) card combination is in a predetermined one of (a) S, (b) C or (c) S+C.

8. The method of claim 7 comprising designating at least one card as a trigger to increase the value of the bonus award and if the trigger card appears in a preselected one of (i) the initial set S, (ii) set C or (iii) sets S and C, increasing the award issued to the player based upon said trigger.

9. The method of claim 7 comprising designating 7s cards as triggers and increasing the award to the player according to

TABLE 3

| Predetermined Number of Cards | Award (times side wager) |
|---|---|
| 3 | 1 |
| 4 | 2 |
| 5 | 5 |
| 6 | 10 |
| 7 | 25 |
| 8 | 100 |
| 9 | 1000. |

.

10. The method of claim 1 comprising issuing an award to the player based upon the amount of the side wager and the value sum of the cards of set S.

11. The method of claim 10 comprising issuing an award to the player based upon the side wager and the value sum of set of the cards of set S according to

TABLE 4

| | Sum of cards in the dealer's hand that exceeds target value | |
|---|---|---|
| Initial Dealer 2-card Total | Award if 5 or Fewer Cards | Award if 6 or More Cards |
| 2 (A & A) | 30 | 60 |
| 3 | 15 | 30 |
| 4 | 8 | 12 |
| 5 to 9 | 3 | 10 |
| 10 | 3 | 50 |
| 11 | 3 | 50 |
| 12 | 1 | 100 |
| 13 | 1 | 1000 |
| 14 or more | 1 | impossible. |

.

12. An improved method for playing a Blackjack-style card game using representations of a deck of cards, where the rules of the game have a predetermined target value and where according to the rules of the game the dealer's hand receives an initial set of cards S, the improved method comprising:

each player making a main wager according to the rules thereof and an optional side wager;

distributing cards to the player and to the dealer according to the rules of the game;

the dealer and player completing their hands according to the rules of the game including the dealer's hand receiving a set of cards C in addition to said initial set S;

resolving the game wager according to the rules of the game;

resolving the side wager according to the rules of, (1) if the dealer's hand does not exceed the predetermined target value, the player losing their side wager; and (2) if the dealer's hand exceeds the predetermined target value and the sum value of the cards in S is of a predetermined value issuing a bonus award to the player, otherwise the player losing their side wager.

13. The method of claim 12 comprising designating at lease one of (i) a card value or (ii) a card combination as a trigger and if the trigger is in a predetermined one of (a) set S, (b) set C or (c) sets S+C increasing the award to the player.

14. The method of claim 13 comprising designating 6*s* as the trigger.

15. The method of claim 14 comprising issuing an award to the player based upon the side wager according to the following

TABLE 5

| | Does the multiplier exist in the dealer's hand that exceeds target value? | |
|---|---|---|
| Initial Dealer 2-card Total | Award if Dealer's Hand Does Not Include Trigger When Dealer's Hand Exceeds Predetermined Target Value | Award if Dealer's Hand Includes Trigger When Dealer's Hand Exceeds Predetermined Target Value |
| 2 (A & A) | 20 | 500 |
| 3 | 10 | 50 |
| 4 | 6 | 30 |
| 5 | 3 | 20 |
| 6 to 11 | 3 | 5 |
| 12 to 13 | 1 | 3 |
| 14 or more | 1 | 1. |

.

16. The method of claim 14 comprising issuing an award to the player based upon the side wager according to the following

TABLE 5.1

| Initial Dealer 2-card Total | Does the multiplier exist in the dealer's hand that exceeds 21? Award if Dealer's Hand Does Not Include Trigger When Dealer's Hand Exceeds 21 | Award if Dealer's Hand Includes Trigger When Dealer's Hand Exceeds 21 |
|---|---|---|
| 2 (A & A) | 20 | 500 |
| 3 | 10 | 50 |
| 4 | 6 | 30 |
| 5 | 3 | 20 |
| 6 to 11 | 3 | 5 |
| 12 | 2 | 4 |
| 14 or more | 1 | 1. |

.

17. An improved method for playing a Blackjack-style card game using representations of a deck of cards, where the rules of the game have a predetermined target value and where according to the rules of the game the dealer's hand receives an initial set of cards S, the improved method comprising:

each player making a main wager according to the rules thereof and an optional side wager;

distributing cards to the player and to the dealer according to the rules of the game;

the dealer and player completing their hands according to the rules of the game including the dealer's hand receiving a set of cards C in addition to said initial set S;

resolving the game wager according to the rules of the game;

resolving the side wager according to the rules of, (1) if the dealer's hand does not exceed the predetermined target value, the player losing their side wager; and (2) if the dealer's hand exceeds the predetermined target value and the number of cards in a predetermined one of (i) S, (ii) C or (iii) S+C exceeds a predetermined number, and (3) the player's hand has a predetermined holding, issuing a bonus award to the player, otherwise the player losing their side wager.

18. The method of claim 16 comprising designating said player's hand predetermined holding is a two card summed value of between 17 and 21.

19. The method of claim 16 comprising issuing an enhanced award when said player's hand predetermined holding is a Natural.

20. The method of claim 19 comprising issuing and award to the player based upon the number of cards in the dealer's hand and according to the following

TABLE 6

| Predetermined Number of Cards | Award When Player Does Not Have Natural | Award When Player Has a Natural |
|---|---|---|
| 3 | 1 | 2 |
| 4 | 2 | 4 |
| 5 | 8 | 16 |
| 6 | 20 | 40 |

TABLE 6-continued

| Predetermined Number of Cards | Award When Player Does Not Have Natural | Award When Player Has a Natural |
|---|---|---|
| 7 | 50 | 100 |
| 8 | 500 | 1000 |
| 9 | 5000 | 10000. |

.

21. An improved method for playing a Blackjack-style card game using representations of a deck of cards, where the rules of the game have a predetermined target value and where according to the rules of he the game the dealer's hand receives an initial set of cards S, the improved method comprising:

each player making a main wager according to the rules thereof and an optional side wager;

distributing cards to the player and to the dealer according to the rules of the game;

the dealer and player completing their hands according to the rules of the game including the dealer's hand receiving a set of cards C in addition to said initial set S;

resolving the game wager according to the rules of the game;

resolving the side wager according to the rules of, (1) if the dealer's hand does not exceed the predetermined target value, the player losing their side wager; and (2) if the dealer's hand exceeds the predetermined target value and the sum value of the cards in S is of a predetermined value and (3) the player's hand has a predetermined holding, issuing a bonus award to the player, otherwise the player losing their side wager.

22. The method of claim 21 comprising designated said player's hand predetermined holding is a two card summed value of between 17 and 21.

23. The method of claim 21 comprising issuing an enhanced award when said player's band predetermined holding is a Natural.

24. The method of claim 23 comprising issuing and award to the player based upon the number of cards in the dealer's hand and according to the following

TABLE 7

| Initial Dealer 2-card Total | Award if No Player Natural | Award if Player Natural |
|---|---|---|
| 2 | 40 | 80 |
| 3 | 20 | 40 |
| 4 | 8 | 16 |
| 5 to 9 | 3 | 6 |
| 10 | 3 | 6 |
| 11 | 3 | 6 |
| 12 | 1 | 2 |
| 13 | 1 | 2 |
| 14 or more | 1 | 2. |

.

25. The method of claim 21 further comprising issuing an award to the player based on the side wager, the sum of the value of the cards in set S, the value sum of the first two cards dealt to the player and the number of cards in the dealer's hand.

26. The method of claim 25 comprising issuing an award to the player according to the following

TABLE 8

| | Sum of cards in the dealer's hand that exceeds the target value of 21 | | | |
|---|---|---|---|---|
| | Award if 5 or Fewer Cards | | Award if 6 or More Cards | |
| Initial Dealer 2-card Total | No Player Natural | Player Natural | No Player Natural | Player Natural |
| 2 | 30 | 60 | 80 | 160 |
| 3 | 15 | 30 | 40 | 80 |
| 4 | 8 | 16 | 10 | 20 |
| 5 to 9 | 3 | 6 | 10 | 20 |
| 10 | 3 | 6 | 30 | 60 |

TABLE 8-continued

| | Sum of cards in the dealer's hand that exceeds the target value of 21 | | | |
|---|---|---|---|---|
| | Award if 5 or Fewer Cards | | Award if 6 or More Cards | |
| Initial Dealer 2-card Total | No Player Natural | Player Natural | No Player Natural | Player Natural |
| 11 | 3 | 6 | 30 | 60 |
| 12 | 1 | 2 | 100 | 200 |
| 13 | 1 | 2 | 1000 | 2000 |
| 14 or more | 1 | 2 | impossible | impossible. |

.

* * * * *